US010822929B2

(12) United States Patent
Ewing et al.

(10) Patent No.: US 10,822,929 B2
(45) Date of Patent: Nov. 3, 2020

(54) ELECTROHYDRAULIC MOVEMENT OF DOWNHOLE COMPONENTS AND METHOD

(71) Applicants: Daniel Ewing, Katy, TX (US); Carlos Prieto, Katy, TX (US); Christopher Ryan Hern, Kingwood, TX (US)

(72) Inventors: Daniel Ewing, Katy, TX (US); Carlos Prieto, Katy, TX (US); Christopher Ryan Hern, Kingwood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 303 days.

(21) Appl. No.: 15/368,377

(22) Filed: Dec. 2, 2016

(65) Prior Publication Data

US 2018/0155996 A1 Jun. 7, 2018

(51) Int. Cl.

| | |
|---|---|
| ***E21B 43/10*** | (2006.01) |
| ***E21B 23/04*** | (2006.01) |
| *H01T 14/00* | (2006.01) |

(52) U.S. Cl.

CPC ..... *E21B 43/105* (2013.01); *E21B 23/04* (2013.01); *E21B 43/106* (2013.01); *H01T 14/00* (2013.01)

(58) Field of Classification Search

CPC ..... E21B 43/10; E21B 43/103; E21B 43/105; E21B 43/106; E21B 43/108; E21B 23/04; H01T 14/00

See application file for complete search history.

(56) References Cited

U.S. PATENT DOCUMENTS

| | | | | |
|---|---|---|---|---|
| 3,517,256 | A * | 6/1970 | Barbini | H03K 3/537 315/155 |
| 3,571,745 | A * | 3/1971 | Altman | H01S 3/038 313/623 |
| 5,903,518 | A * | 5/1999 | Benwell | G10K 15/06 367/139 |
| 6,474,534 | B2 * | 11/2002 | Gabbianelli | B21C 37/154 228/131 |
| 6,877,567 | B2 * | 4/2005 | Hirth | E21B 43/10 166/118 |
| 2007/0205001 | A1 * | 9/2007 | Shuster | B21D 39/04 166/380 |
| 2010/0252252 | A1 * | 10/2010 | Harris | E21B 23/01 166/118 |

(Continued)

OTHER PUBLICATIONS

"High Energy Rate Forming", [retrieved on Oct. 31, 2016], 4 pages. Retrieved from the internet:,URL:http://thelibraryofmanufacturing.com/high_energy_rate_forming.html http://www.bmax.com.

*Primary Examiner* — Christopher J Sebesta
(74) *Attorney, Agent, or Firm* — Cantor Colburn LLP

(57) ABSTRACT

A downhole electrohydraulic movement arrangement including a spark gap device positioned and configured to move a separate component, and an energy source electrically connected to the spark gap device. A method for moving a component in a downhole environment including disposing an electrohydraulic arrangement having a spark gap device and an energy source electrically connected to the spark gap device operably proximate a component, actuating the spark gap device, generating a pressure wave with the spark gap device, and moving the component with the pressure wave. A downhole system including a borehole, a component moved within the borehole by an electrohydraulic arrangement.

20 Claims, 11 Drawing Sheets

(56) References Cited

U.S. PATENT DOCUMENTS

2012/0285702 A1* 11/2012 Rytlewski ..... E21B 34/063
166/373
2014/0076581 A1* 3/2014 Gorrara ..... E21B 43/10
166/380

* cited by examiner

ELECTROHYDRAULIC MOVEMENT OF DOWNHOLE COMPONENTS AND METHOD

BACKGROUND

In the drilling and completion industry, many components require movement, that movement ranging from simply displacing a sleeve from one position to another where a flow capability changes due to the movement up to plastically deforming components to permanently join them with other components such as setting a liner. The art has devised a plethora of actuators to effect such movement of components in the downhole environment a majority of which function well for their intended purposes. The art recognizes however that efficiency is omnipotent particularly in depressed oil periods. Effecting movement through the use of less energy by focusing the energy used and minimizing wasted energy both reduces the cost of the movement and reduces deleterious effects on other downhole components that might otherwise take place.

The art would therefore favorably receive alternative means and methods for moving downhole components.

SUMMARY

A downhole electrohydraulic movement arrangement including a spark gap device positioned and configured to move a separate component, and an energy source electrically connected to the spark gap device.

A method for moving a component in a downhole environment including disposing an electrohydraulic arrangement having a spark gap device and an energy source electrically connected to the spark gap device operably proximate a component, actuating the spark gap device, generating a pressure wave with the spark gap device, and moving the component with the pressure wave.

A downhole system including a borehole, a component moved within the borehole by an electrohydraulic arrangement.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
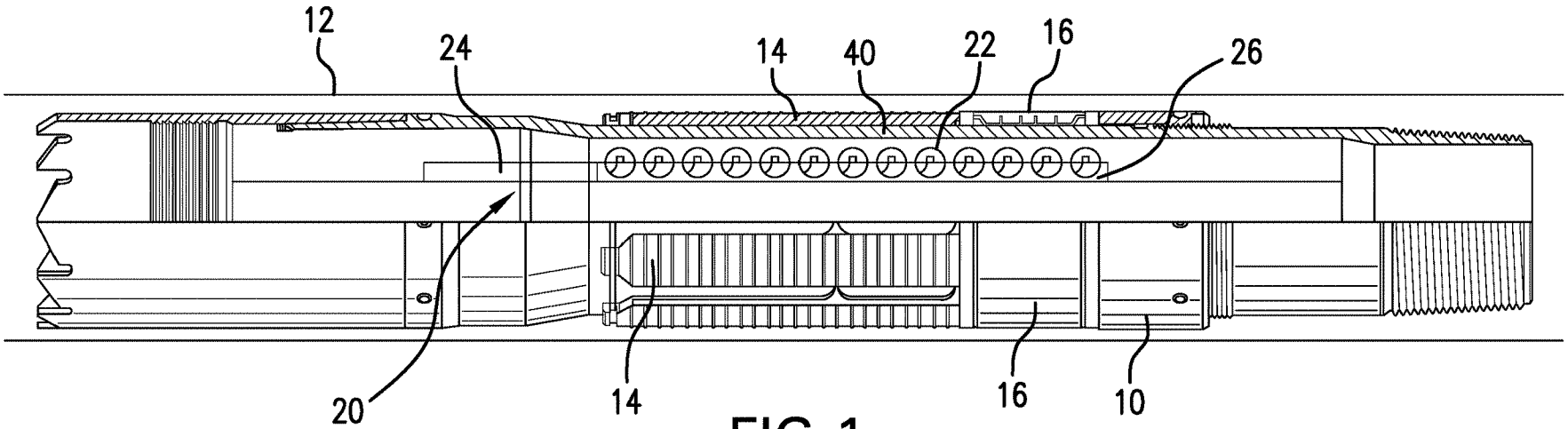
FIG. 1 is a schematic three quarter section view of an embodiment of a downhole arrangement configured for electrohydraulic movement.

Referring to FIG. 1, an embodiment of a downhole arrangement configured for electrohydraulic movement is illustrated. It is to be appreciated that the concept taught herein is broader than the specific drawings and can be used to move any component relative to another with appropriate directional consideration. As illustrated in FIG. 1, one embodiment is intended to provide insight into the overall concept. The FIG. 1 illustration includes a component 10 such as a liner hanger that is to be installed in a borehole or casing 12. The liner hanger may include slips 14 and/or a packer 16. Disposed within the liner hanger 10 is an electrohydraulic movement arrangement 20 comprising a spark gap device 22 connected to an energy source 24.

Figure 2:
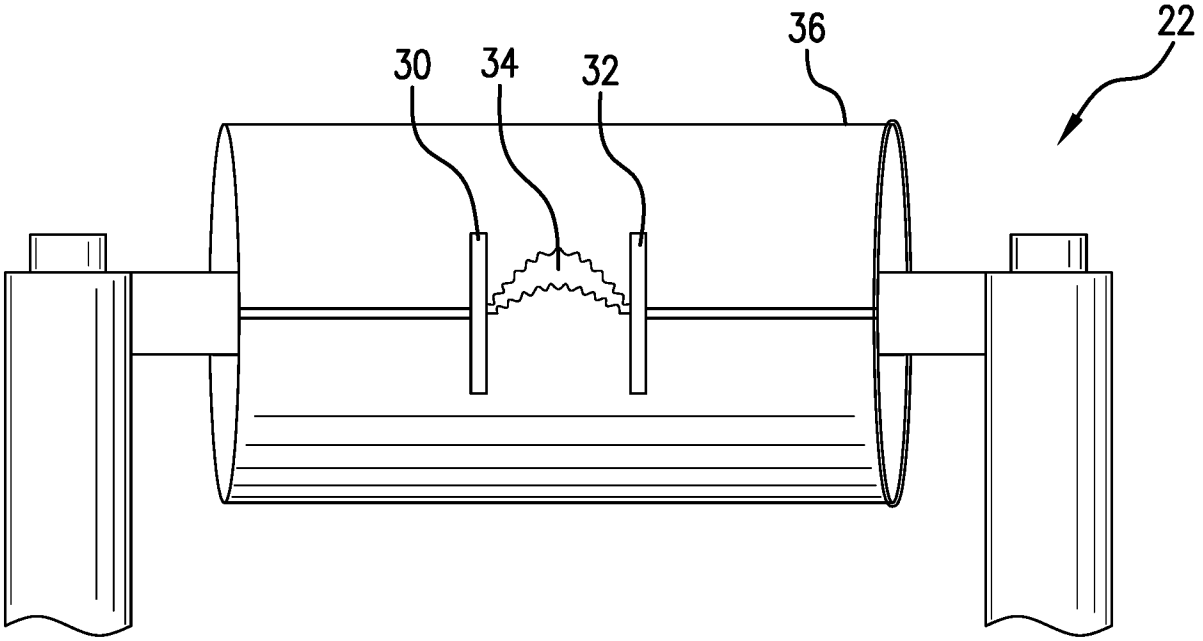
FIG. 2 is a schematic view of an encapsulated spark gap device.

Referring to FIG. 2, a spark gap device 22 comprises electrodes 30 and 32 spaced from one another where a charge may be built on one side until it jumps to the other side as an electrical arc 34. The arc vaporizes a liquid disposed between the two electrodes initiating a pressure wave. In some embodiments the arc may be guided by a lower resistance tether between the electrodes. When arranged properly, the pressure wave is usable to cause movement of a component. And while a spark gap device may generate an arc in most liquids, it is desirable that the liquid in contact with the spark gap electrodes is a more dielectric liquid as opposed to one that is very conductive since conductive liquids will tend to conduct electric energy away from the electrode rather than allow build up. This would cause any resulting arc to be feebler, if generated at all. Since the pressure wave desired in the disclosure hereof depends upon the vaporization of liquid and resulting pressure wave, a feeble arc would be counterproductive. To this end, some of the embodiments disclosed below encapsulate the electrodes in an envelope 36 and fill the encapsulated space with a dielectric fluid. The envelope 36 is vaporized along with the fluid therein or otherwise easily breached so as to pose no or little impediment to the expanding pressure wave. In other embodiments, the individual spark gap devices are not encapsulated but are collectively maintained within a more dielectric fluid that is otherwise extant wellbore fluid for example by placing the spark gap devices collectively inside a barrier.

Figure 4:
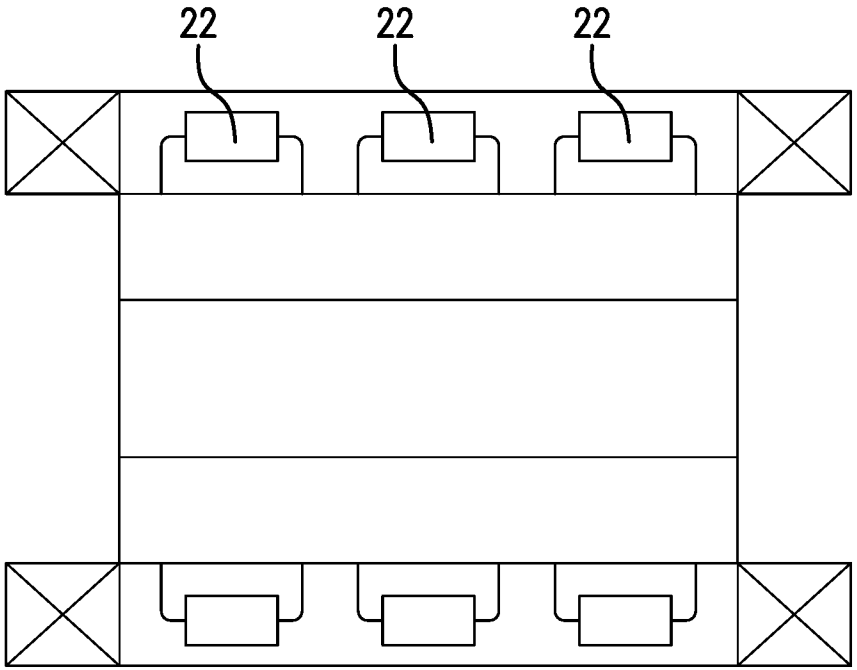
FIGS. 3 and 4 are schematic layout illustrations for spark gap devices.
Figure 3:
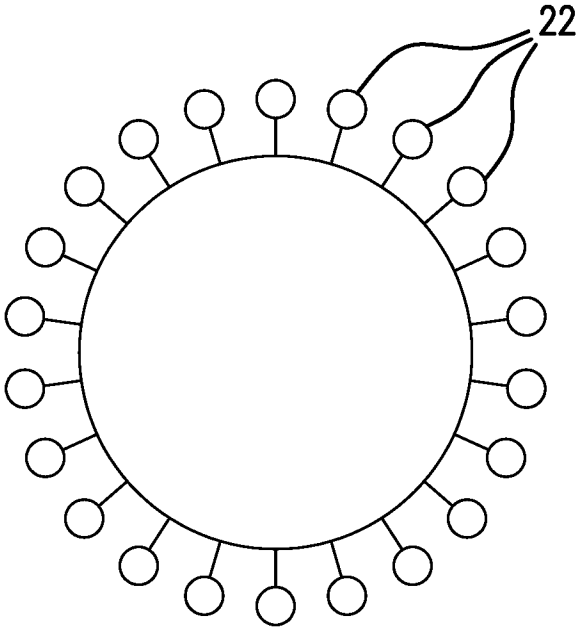

It is to be understood that the spark gap device 22 may be one or more devices, individually encapsulated or not, depending upon the intended area to be impacted by the pressure wave, the degree of movement desired and the magnitude of force required for the movement. Further, the particular positioning and or patterning of the spark devices where more than one is used is related to desired action. For example, multiple spark gap devices may be configured axially or may be configured perimetrically (which may be circumferentially), in an array, etc. depending upon how the pressure wave is desired to act on a component 10. Two possible configurations of a multitude of spark gap devices are illustrated schematically in FIGS. 3 and 4, for example.

The energy source 24 may be a remote source electrically connected to the arrangement or may be a local source. The source may be a capacitor, a capacitor bank, a battery, a generator, etc. It is desirable that the energy be deliverable rapidly to the spark gap device.

Referring again to FIG. 1, it will be noticed that a number of spark gap devices 22 are spread radially inwardly of both the slip 14 and the packer 16. The spark gap devices 22 are mounted on a mandrel 26. While only a quarter section is in view, this embodiment will likely employ the configuration of both FIGS. 3 and 4 of an axially extended and circumferentially complete pattern of spark gap devices, essentially forming a cylinder of spark gap devices 22. As this embodiment does not otherwise cordon off a section of the string around the spark gaps devices 22, they may be individually encapsulated so that an optimized dielectric fluid may be disposed about the electrodes. Upon firing of the spark gap devices, the arcs will vaporize fluid as described above each generating a pressure wave that collectively impact the tubular 40 disposed directly radially inside of the slips 14 and packer 16. The pressure wave will deform the tubular 40 radially outwardly to cause the slips 14 to bite into the borehole or casing 12 and the packer 16 to seal thereagainst.

Figure 5:
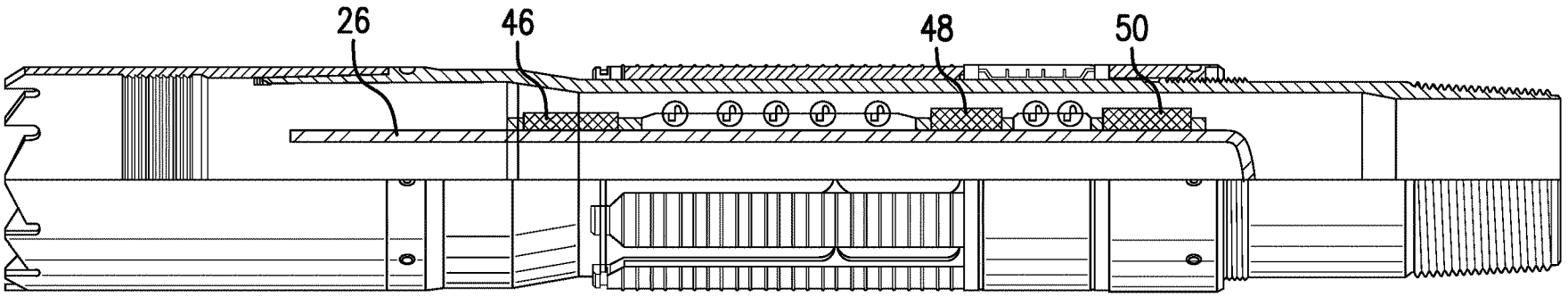
FIG. 5 is a schematic view of another embodiment of a downhole arrangement configured for electrohydraulic movement.
Figure 6:
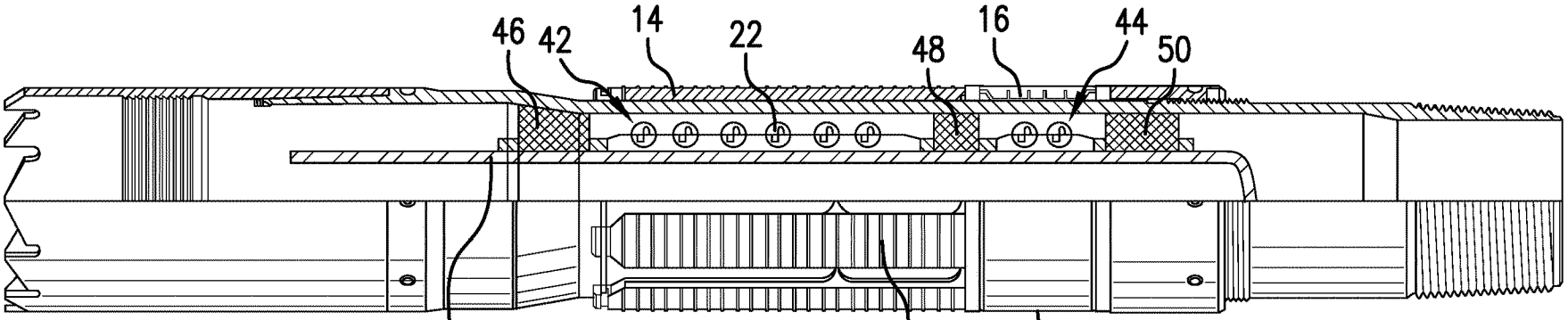
FIG. 6 is the embodiment of FIG. 5 in another position.

In another embodiment, referring to FIGS. 5 and 6, it will be appreciated that spark gap devices 22 have been separated into different banks of devices that will here be termed slip bank 42 and packer bank 44 for differentiation purposes only and without limitations implied. The banks are separated by sealing elements 46, 48 and 50 illustrated in FIG. 5 in a run in condition and in FIG. 6 in a deployed condition. The elements may be swellable, shape memory, mechanically set, etc. and have the function of containing and therefore directing the pressure resulting from the spark gap devices being actuated. The devices 22 in the illustrations are encapsulated but it is noted that this embodiment could also send a pill to the location of the devices 22 followed by the setting of the seal elements thereby displacing other fluids and surrounding the devices 22 with dielectric fluid. It is also to be appreciated that the separation facilitates actuating one bank before the other or both simultaneously as desired by the operator. For example, in some iterations, the operator may want to set the slips 14 before the packer 16.

Figure 7:
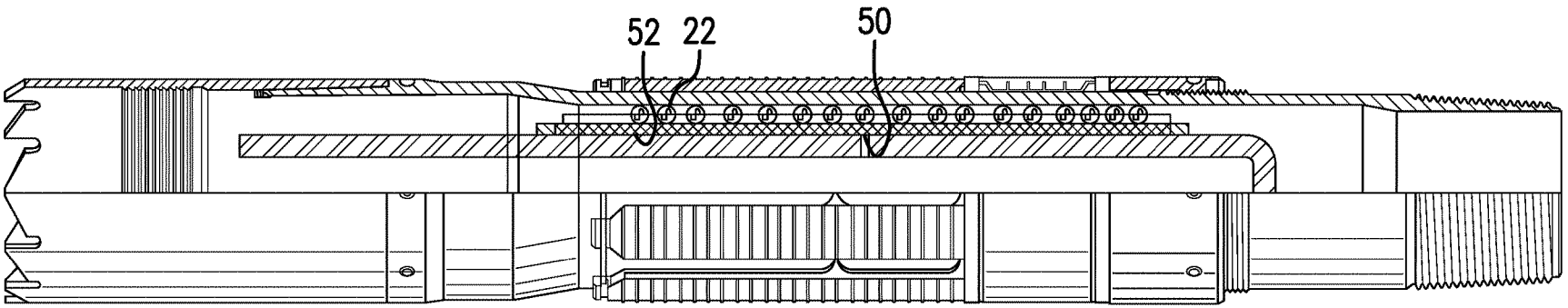
FIG. 7 is a schematic view of yet another embodiment of a downhole arrangement configured for electrohydraulic movement.
Figure 8:
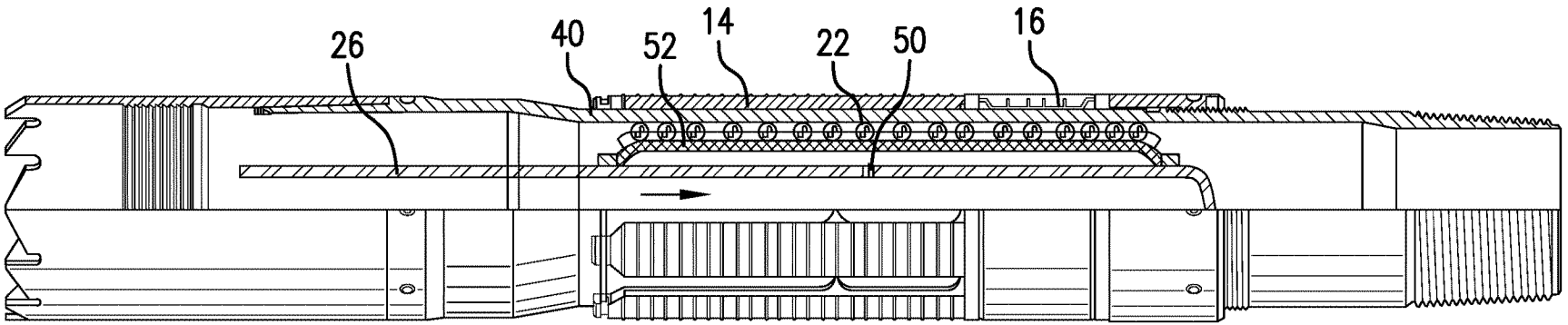
FIG. 8 is the embodiment of FIG. 7 in another position.
Figure 8A:
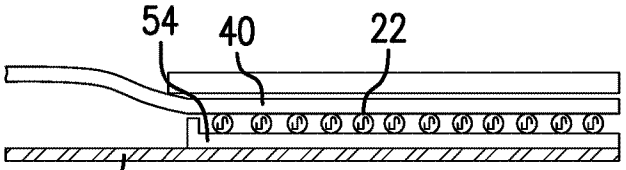
FIGS. 8A-C are an embodiments similar to FIG. 7, but with a different radial displacement mechanisms.
Figure 8B:
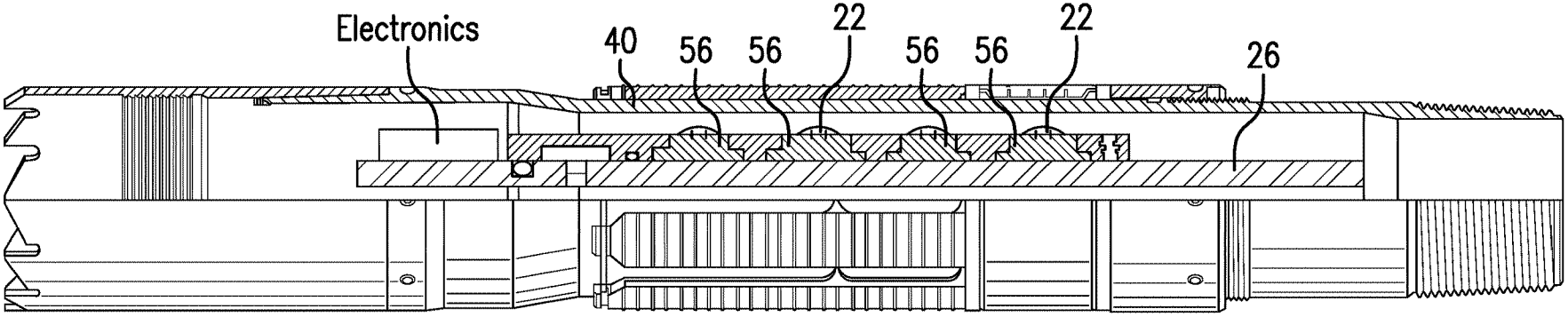
Figure 8C:
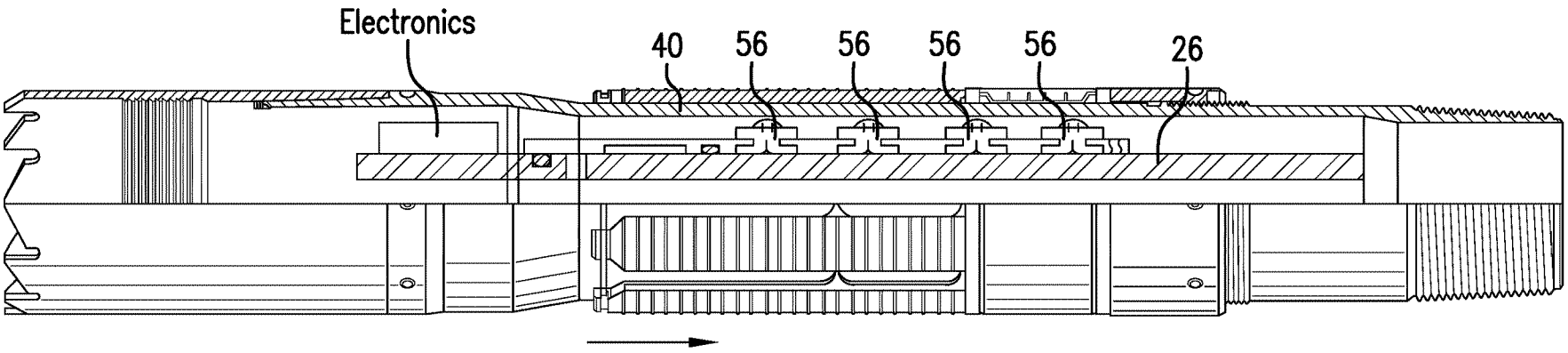

In yet another embodiment, referring to FIGS. 7 and 8, the mandrel 26 is configured with a port 50 that may be fitted with a check valve in some iterations, and includes an inflatable 52 in sealed communication therewith. Fluid pressure thorough mandrel 26 is ported through port 50 to a space defined in part by the mandrel 26 and in part by the inflatable 52 resulting in the inflation of inflatable 52 and consequently the displacement of the devices 22 toward the tubular 40 that is the subject of the pressure wave. The closer the devices 22 are to the subject, the greater the impact of the force generated by the devices 22 since there is less time for attenuation of the pressure wave. Accordingly, this embodiment results in more of the energy of the pressure wave being imparted to the tubular 40. It is to be understood that although an inflatable is used to displace the devices 22, this is not the only way to effect that displacement. Other iterations will substitute a swellable or shape memory material for the inflatable in the same relative position in the arrangement with similar effect. This could also be effected by driving a solid sleeve 54 between the mandrel 26 and the devices 22 (see FIG. 8A) or substituting one or more compression elements 56 for the inflatable 52 (see FIGS. 8B and 8C). In such an embodiment, resulting force imparted to the tubular 40 might even be higher as the solid sleeve is likely to yield less than the inflatable, swellable, etc. so that absorption of energy in the wrong direction is minimized.

Figure 9:
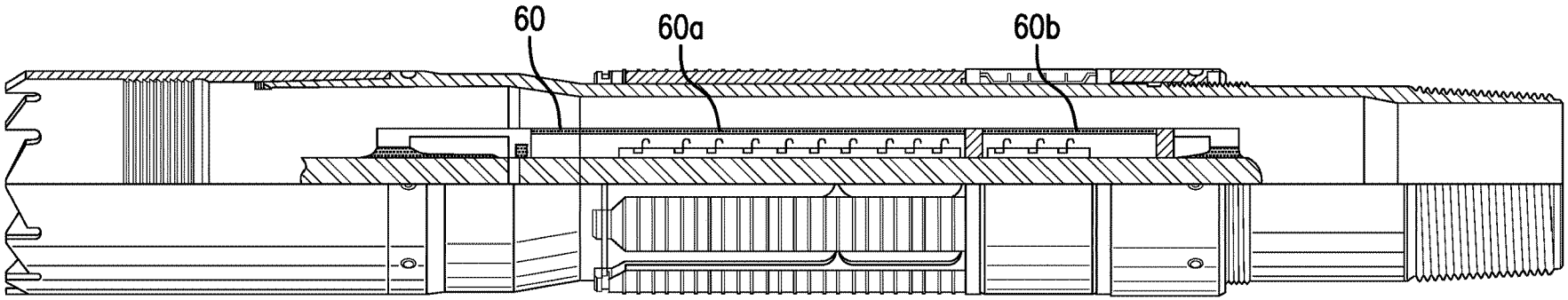
FIG. 9 is a schematic view of still another embodiment of a downhole arrangement configured for electrohydraulic movement.
Figure 10:
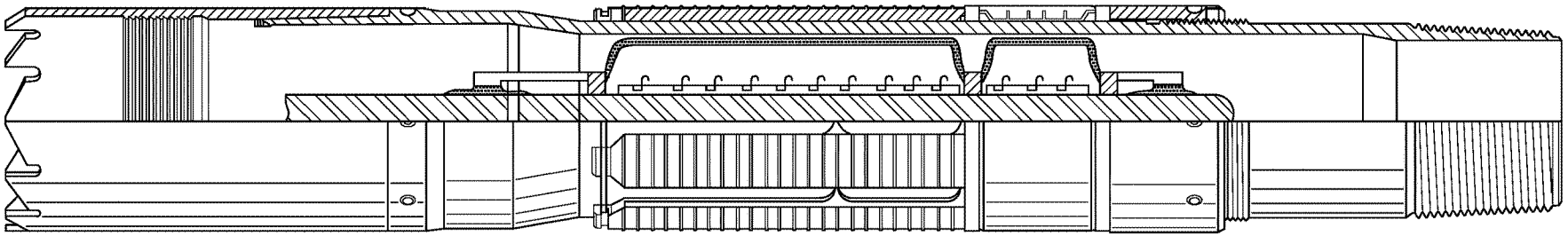
FIG. 10 is the embodiment of FIG. 9 in another position.

Referring to FIGS. 9 and 10, another embodiment is primarily configured to avoid the need for encapsulated spark gap devices 22. This embodiment collectively protects devices 22 from the environment by running them in the hole inside a sealing element 60, which as illustrated is two elements 60*a* and 60*b* but one could be used or more could be used depending upon how many sub banks of devices 22 are desired. As illustrated, sealing element 60 is a mechanical packer (here two mechanical packers 60*a* and 60*b*) that contain a dielectric fluid provided at surface such that encapsulations of the devices 22 are not needed. The devices 22 in area 60*a* and 60*b* may be actuated independently or they may be actuated simultaneously. In other respects the embodiment works as do the foregoing.

Figure 11:
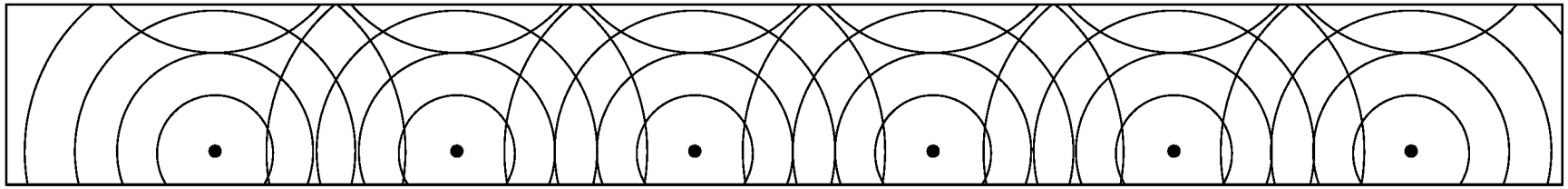
FIG. 11 is a view illustrating wave propagation resulting from simultaneous spark gap device timing.
Figure 12:
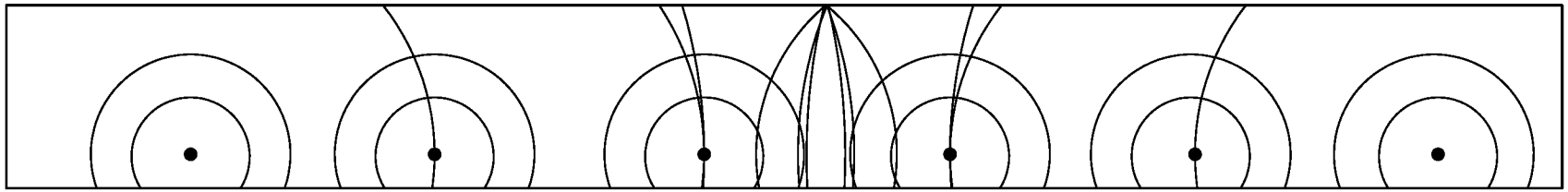
FIG. 12 is a view illustrating wave propagation resulting from sequential spark gap device timing.

Referring to FIGS. 11 and 12, pressure waves generated by individual devices 22 are illustrated showing primary and later interactions with their surroundings. This is to illustrate that timing of actuation of individual devices 22 can be controlled so that different effects are realized. More specifically, FIG. 11 illustrates a simultaneous actuation effect. The pressure against the wall opposite the devices is relatively uniform over its surface area. Deformation of the wall will hence be relatively uniform as well. In FIG. 12, the effects of a timed actuation is illustrated. Specifically, if one were to label the devices 22 from 1 to 6, left to right and actuate 1/6, then 2/5 then 3/4 in a sequence and at a time interval that is determinable by the speed of the pressure wave in the medium being used and the distance between adjacent devices 22, it is possible to have primary waves from each device 22 meet at a central point as shown. Since the amplitude of the wave is additive, the total magnitude of pressure acting on the wall in that point is much higher than for individual devices 22. Accordingly, greater deformation in this location or even a separation of the material at this point can be achieved. With selected size and number of devices, dielectric fluid placement and timing, it is possible to sever a tubular with the pressure wave. In another sequential actuation, a progressing wave of pressure may be generated by actuating devices at one end of the plurality of devices and in a timed manner actuating next adjacent devices in a sequence until all of the devices are actuated.

Figure 13:
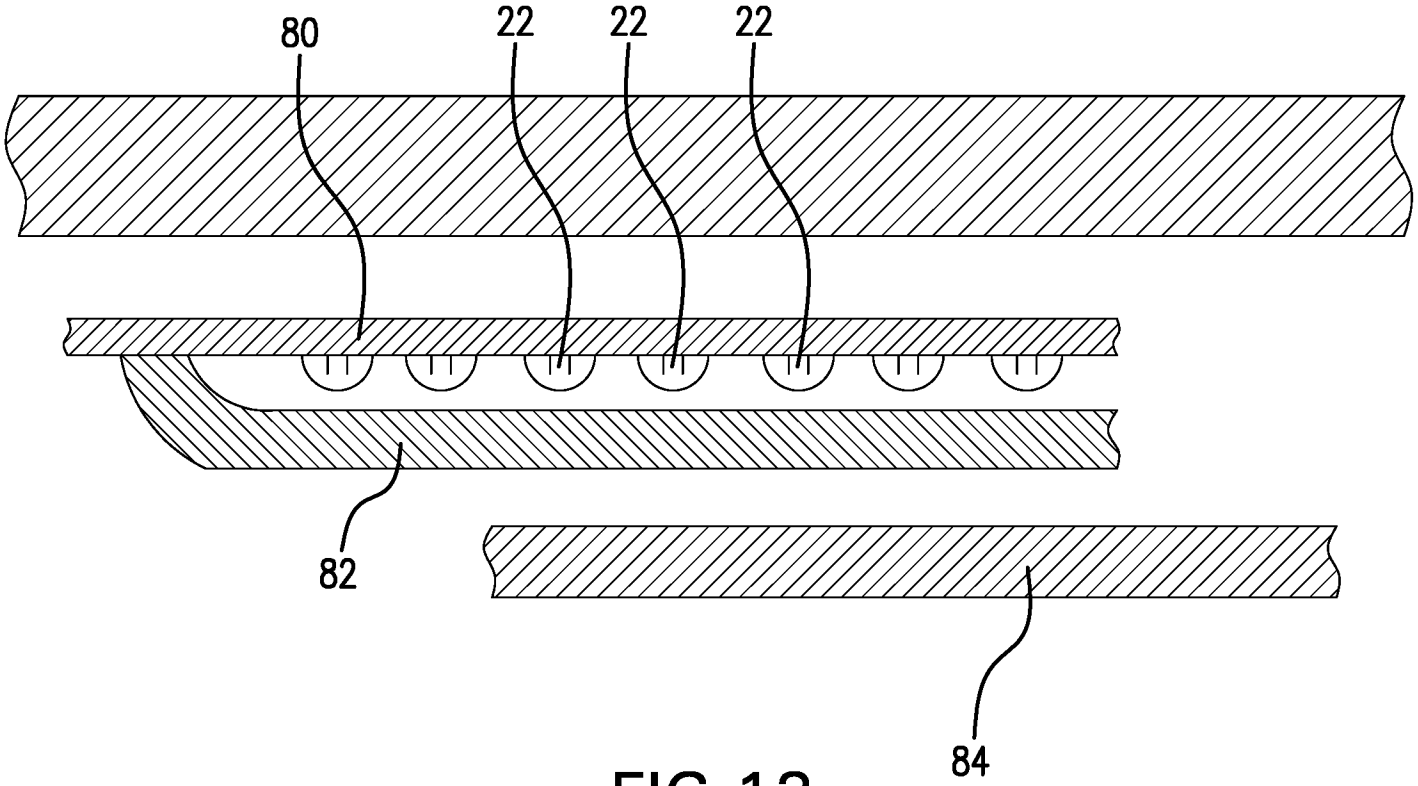
FIG. 13 is a schematic representation of a radially inward movement embodiment.
Figure 14:
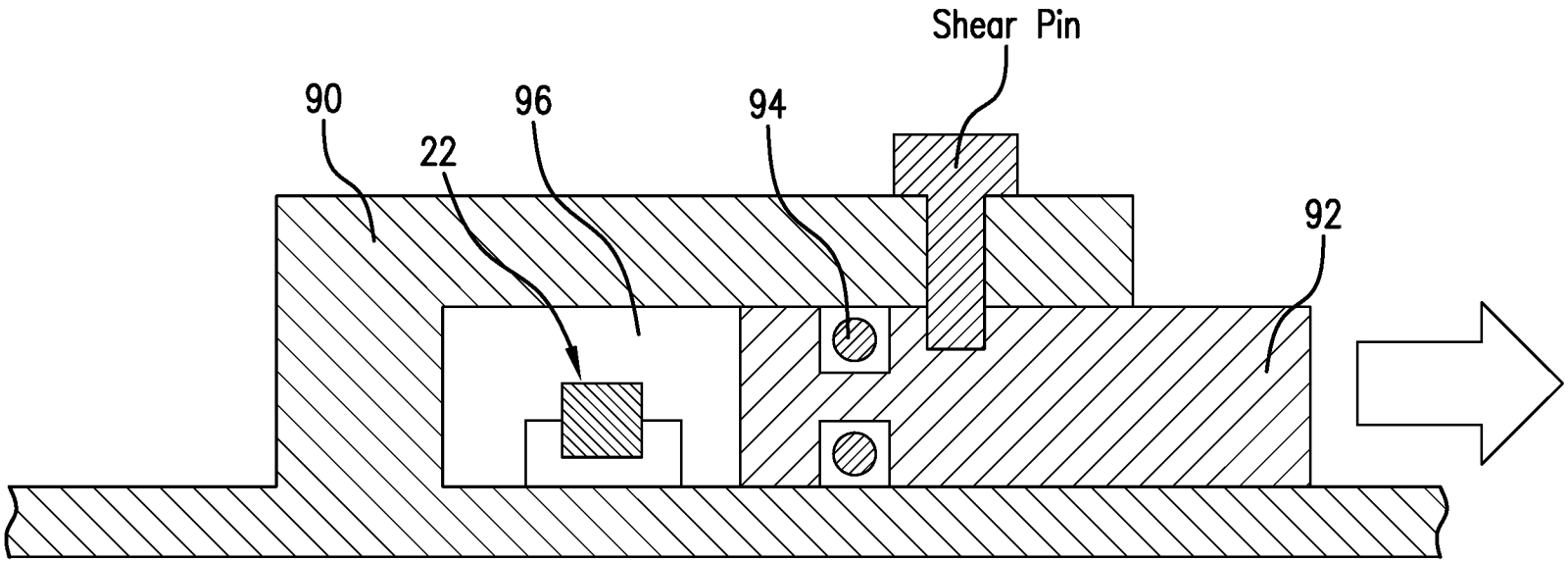
FIG. 14 is a schematic representation of a piston based directional movement embodiment.

FIGS. 13 and 14 are schematic views of embodiments that cause the movement of a component in directions other than radially outwardly to exemplify the unlimited directional movement applications of the present invention. FIG. 13 illustrates a configuration that will move a component radially inwardly. In this embodiment, a mandrel 80 is disposed radially outwardly of a gripper component 82. The mandrel 80 is configured to resist the pressure wave generated by the devices 22 so that the gripper component 82 is forced to move radially inwardly into gripping contact with a fish 84. The gripping contact may be frictional or may produce a bond or weld. FIG. 14 produces movement, that may be axial or other direction, through the use of a housing 90 and piston 92 movable within the housing. The piston 92 is sealed to the housing 90 with seals 94. The piston 92 and housing 90 define a chamber 96 wherein one or more devices 22 reside. A fluid (not shown) will also reside in the chamber 96 to be vaporized upon actuation of the devices 22. Upon actuation the resulting pressure wave will force the piston 92 to move. The piston may be connected to other components as desired.

It is important to recognize that as noted above, the invention is not limited to expanding a tubular but rather is intended to be a movement arrangement (radially outwardly, inwardly, axially, rotational or any combination thereof) where one or more spark gap devices are positioned to emit a pressure wave toward a component to be moved, impacting that component with the pressure wave resulting in the movement of that component. The movement may include plastic deformation, elastic deformation or no deformation at all but rather simply a positional change of the component.

Methodically, the arrangement is run into a borehole whether cased hole or open hole. In some embodiments the method will then include setting a sealing element about the devices 22. The devices 22 are actuated simultaneously or in a sequence and the subject of the pressure wave is moved, the movement ranging from positional thorough inelastic deformation to elastic deformation.

Further contemplated is a downhole system including a borehole 12 and a component 10 in the borehole. The component 10 is moved within the borehole by an electrohydraulic arrangement 20.

Set forth below are some embodiments of the foregoing disclosure:

Embodiment 1

A downhole electrohydraulic movement arrangement including a spark gap device positioned and configured to move a separate component, and an energy source electrically connected to the spark gap device.

Embodiment 2

The arrangement as in any prior embodiment wherein the spark gap device is a plurality of devices.

Embodiment 3

The arrangement as in any prior embodiment wherein the spark gap device is encapsulated.

Embodiment 4

The arrangement as in any prior embodiment wherein a selected liquid is disposed within the encapsulation.

Embodiment 5

The arrangement as in any prior embodiment wherein the liquid is dielectric.

Embodiment 6

The arrangement as in any prior embodiment wherein each of the plurality of spark gap devices is individually actuable.

Embodiment 7

The arrangement as in any prior embodiment wherein each spark gap device is actuatable at different times to produce a sequence of pressure waves.

Embodiment 8

The arrangement as in any prior embodiment wherein the plurality of devices are arranged perimetrically.

Embodiment 9

The arrangement as in any prior embodiment wherein the plurality of devices are arranged circumferentially.

Embodiment 10

The arrangement as in any prior embodiment wherein the plurality of devices are arranged axially.

Embodiment 11

The arrangement as in any prior embodiment wherein the plurality of devices are arranged in an array.

Embodiment 12

The arrangement as in any prior embodiment wherein the energy source is a capacitor.

Embodiment 13

The arrangement as in any prior embodiment wherein the component is a liner hanger.

Embodiment 14

A method for moving a component in a downhole environment including disposing an electrohydraulic arrangement having a spark gap device and an energy source electrically connected to the spark gap device operably proximate a component, actuating the spark gap device, generating a pressure wave with the spark gap device, and moving the component with the pressure wave.

Embodiment 15

The method as in any prior embodiment wherein the spark gap device is a plurality of devices simultaneously actuated.

Embodiment 16

The method as in any prior embodiment wherein the spark gap device is a plurality of devices sequentially actuated.

Embodiment 17

The method as in any prior embodiment wherein the sequential actuation is from longitudinal end points of the spark gap devices inwardly.

Embodiment 18

The method as in any prior embodiment wherein the sequential actuation is from one longitudinal end of the spark gap devices to the opposite longitudinal end of the spark gap devices.

Embodiment 19

A downhole system including a borehole, a component moved within the borehole by an electrohydraulic arrangement.

Embodiment 20

The system as in any prior embodiment wherein the component is a liner hanger.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole electrohydraulic movement arrangement comprising:

a spark gap device positioned and configured to vaporize a fluid to generate a pressure wave that impacts a separate structural component, the pressure wave alone directly causing plastic deformation without rupturing of that separate component from a first position to a second position; and an energy source electrically connected to the spark gap device.

2. The arrangement as claimed in claim 1 wherein the spark gap device is a plurality of devices.

3. The arrangement as claimed in claim 1 wherein the spark gap device is encapsulated.

4. The arrangement as claimed in claim 3 wherein a selected liquid is disposed within the encapsulation.

5. The arrangement as claimed in claim 4 wherein the liquid is dielectric.

6. The arrangement as claimed in claim 2 wherein each of the plurality of spark gap devices is individually actuable.

7. The arrangement as claimed in claim 2 wherein each spark gap device is actuatable at different times to produce a sequence of pressure waves.

8. The arrangement as claimed in claim 2 wherein the plurality of devices are arranged perimetrically.

9. The arrangement as claimed in claim 2 wherein the plurality of devices are arranged circumferentially.

10. The arrangement as claimed in claim 2 wherein the plurality of devices are arranged axially.

11. The arrangement as claimed in claim 2 wherein the plurality of devices are arranged in an array.

12. The arrangement as claimed in claim 1 wherein the energy source is a capacitor.

13. The arrangement as claimed in claim 1 wherein the component is a liner hanger.

14. A method for moving a component in a downhole environment comprising:

disposing an electrohydraulic arrangement having a spark gap device and an energy source electrically connected to the spark gap device operably proximate a component;

actuating the spark gap device;

vaporizing a fluid to generate a pressure wave with the spark gap device, the pressure wave impacting the component; and plastically deforming without rupturing the component from a first position to a second position with the pressure wave alone.

15. The method as claimed in claim 14 wherein the spark gap device is a plurality of devices simultaneously actuated.

16. The method as claimed in claim 14 wherein the spark gap device is a plurality of devices sequentially actuated.

17. The method as claimed in claim 16 wherein the sequential actuation is from longitudinal end points of the spark gap devices inwardly.

18. The method as claimed in claim 16 wherein the sequential actuation is from one longitudinal end of the spark gap devices to the opposite longitudinal end of the spark gap devices.

19. A downhole system comprising:

a borehole;

a structural component moved within the borehole by an electrohydraulic arrangement, the arrangement comprising:

a spark gap device positioned and configured to vaporize a fluid to generate a pressure wave that impacts the structural component, the pressure wave alone directly causing plastic deformation without rupturing of that structural component from a first position to a second position; and an energy source electrically connected to the spark gap device.

20. The system as claimed in claim 19 wherein the component is a liner hanger.

* * * * *